US010781006B2

(12) United States Patent
Kirsch et al.

(10) Patent No.: US 10,781,006 B2
(45) Date of Patent: Sep. 22, 2020

(54) PACKAGING MACHINE FOR PACKAGING WITH STRETCH FILM AND OPTIMIZED PACKAGING METHOD

(71) Applicant: Bizerba SE & Co. KG, Balingen (DE)

(72) Inventors: Sascha Kirsch, Burladingen (DE); Eugen Elis, Rohrdorf (DE)

(73) Assignee: BIZERBA SE & CO. KG, Balingen (DE)

( * ) Notice: Subject to any disclaimer, the term of this patent is extended or adjusted under 35 U.S.C. 154(b) by 32 days.

(21) Appl. No.: 16/396,804

(22) Filed: Apr. 29, 2019

(65) Prior Publication Data

US 2019/0389607 A1 Dec. 26, 2019

(30) Foreign Application Priority Data

Jun. 25, 2018 (EP) ..... 18179617

(51) Int. Cl.
*B65B 11/54* (2006.01)
*B65B 41/12* (2006.01)
*B65B 59/00* (2006.01)

(52) U.S. Cl.
CPC ..... *B65B 11/54* (2013.01); *B65B 41/12* (2013.01); *B65B 59/003* (2019.05); *B65B 59/005* (2013.01)

(58) Field of Classification Search
CPC ..... B65B 11/54; B65B 41/12; B65B 41/14; B65B 59/00; B65B 59/001; B65B 59/003; B65B 59/005; B65B 59/02; B65H 20/06
USPC ..... 53/441, 466, 556, 228, 389.5
See application file for complete search history.

(56) References Cited

U.S. PATENT DOCUMENTS 4,548,024 A * 10/1985 Fine ..... B65B 11/54 53/136.1
5,115,620 A * 5/1992 Takamura ..... B65B 11/54 53/222
5,205,104 A * 4/1993 Nakashima et al. .... B65B 11/54 53/389.2
5,473,861 A * 12/1995 Fukunaga et al. ..... B65B 11/54 53/228
5,501,066 A * 3/1996 Errasti Iriarte et al. ..... B65B 57/12 53/556

(Continued)

FOREIGN PATENT DOCUMENTS

EP 0044820 A1 1/1982
EP 0284538 A1 9/1988

(Continued)

*Primary Examiner* — Stephen F. Gerrity
(74) *Attorney, Agent, or Firm* — Leydig, Voit & Mayer Ltd

(57) ABSTRACT

A packaging machine for packaging products to be packaged by means of a stretchable film includes: a film transport device for a film feed to a product to be packaged; a first and a second belt conveyor for transporting the film, the belt conveyors each including a first and a second belt conveyor that are synchronously driven in a film transport direction prescribed by the film transport device and are arranged side by side, at least the second belt conveyor device being movable in a direction perpendicular to a film transport direction; and a movable film guiding element, by which the film is introducible into the film transport device, the film guiding element including a guide plate for guiding the film that has a first recess and a second recess in an upper edge in a vertical direction toward the belt conveyors.

15 Claims, 8 Drawing Sheets

(56) References Cited

U.S. PATENT DOCUMENTS

| | | | | |
|---|---|---|---|---|
| 6,895,728 | B2 * | 5/2005 | Kondo | B65B 11/54 53/441 |
| 10,703,578 | B2 * | 7/2020 | Ellis | B65B 11/54 |
| 2016/0039552 | A1 * | 2/2016 | Koyama | B65B 11/54 53/556 |
| 2016/0214752 | A1 * | 7/2016 | Ono | B65B 11/54 |
| 2018/0002045 | A1 * | 1/2018 | Tai | B65B 11/54 |
| 2018/0016042 | A1 * | 1/2018 | Kimoto | B65B 11/54 |

FOREIGN PATENT DOCUMENTS

| | | | |
|---|---|---|---|
| EP | 3093244 | B1 | 3/2018 |
| WO | WO 2004000651 | A1 | 12/2003 |

* cited by examiner

PACKAGING MACHINE FOR PACKAGING WITH STRETCH FILM AND OPTIMIZED PACKAGING METHOD

CROSS-REFERENCE TO PRIOR APPLICATION

Priority is claimed to European Patent Application No. EP 18 179 617.8, filed on Jun. 25, 2018, the entire disclosure of which is hereby incorporated by reference herein.

FIELD

The invention relates to a packaging machine and a method for packaging products to be packaged by means of a stretchable film having a film transport device for the film feed to a product to be packaged, and having a first and second belt conveyor for transporting the film, each of which comprises a first and a second belt conveyor that are synchronously driven in a film transport direction specified by the film transport device and are arranged side by side, at least the second belt conveyor being movable in a direction perpendicular to the film transport direction, and with a movable film guiding element, by means of which the film can be introduced into the film transport device, the film guiding element comprising a guide plate for guiding the film that has a first and a second recess in an upper edge in the vertical direction toward the belt conveyors, the first belt conveyor being introducible into the first recess and the second belt conveyor into the second recess, thereby defining a first zero position with respect to the width of the film.

BACKGROUND

EP 3 093 244 B1 discloses such a packaging machine for packaging products to be packaged by means of films which are designed to transfer the stretch film from the supply roll to the packaging device.

The films are conveyed from a film dispensing device via a movable film guiding element to a film transport device. The film transport device has two synchronously operated belt conveyors arranged in parallel. The film is transported by the belt conveyors to a position in the packaging machine in which a product to be packaged can be brought to the film and be packaged in the film. The belt conveyors can be introduced into recesses of a guide plate of the film guiding element by the movement of the film guiding element. This defines a zero position of the belt conveyors. This ensures a reliable transfer of the film from the film guiding element into the film transport device. To "stretch" the film in its transverse direction, the second belt conveyor is movable a short distance relative to the first one. The guide plate is designed as a horizontal plate.

The known packaging machine, however, needs a relatively large space in the x direction. Furthermore, this often results in a sloppy transfer of the film.

The packaging machine is basically designed to package trays of varying size. However, the film transport device can only process films having a defined width. With smaller, that is narrower trays, this results in film being wasted that projects in width far past the tray and must be folded together under the product to be packaged. There is more film there than is actually necessary. In the total cost of packaging, the film constitutes a considerable cost factor, even compared to the tray and the label. Excessive film consumption can make this form of packaging uneconomical compared to other packages.

SUMMARY

In an embodiment, the present invention provides a packaging machine for packaging products to be packaged by means of a stretchable film, comprising: a film transport device for a film feed to a product to be packaged; a first and a second belt conveyor configured to transport the film, the belt conveyors each comprising a first and a second belt conveyor that are synchronously driven in a film transport direction prescribed by the film transport device and are arranged side by side, at least the second belt conveyor device being movable in a direction perpendicular to a film transport direction; and a movable film guiding element, by which the film is introducible into the film transport device, the film guiding element comprising a guide plate configured to guide the film that has a first recess and a second recess in an upper edge in a vertical direction toward the belt conveyors, the first belt conveyor being introducible into the first recess and the second belt conveyor into the second recess, thereby defining a first zero position with respect to a width of the film, wherein the guide plate of the film guiding element is vertically oriented, wherein the guide plate has at least a third recess along its edge facing toward the belt conveyors, the second belt conveyor being introducible into the third recess instead of the second recess in order to establish a second zero position with respect to the width of the film, and/or wherein at least the second recess of the guide plate is formed in a recess element which is displaceable along the upper edge of the guide plate in order to establish the second zero position with respect to the width of the film.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
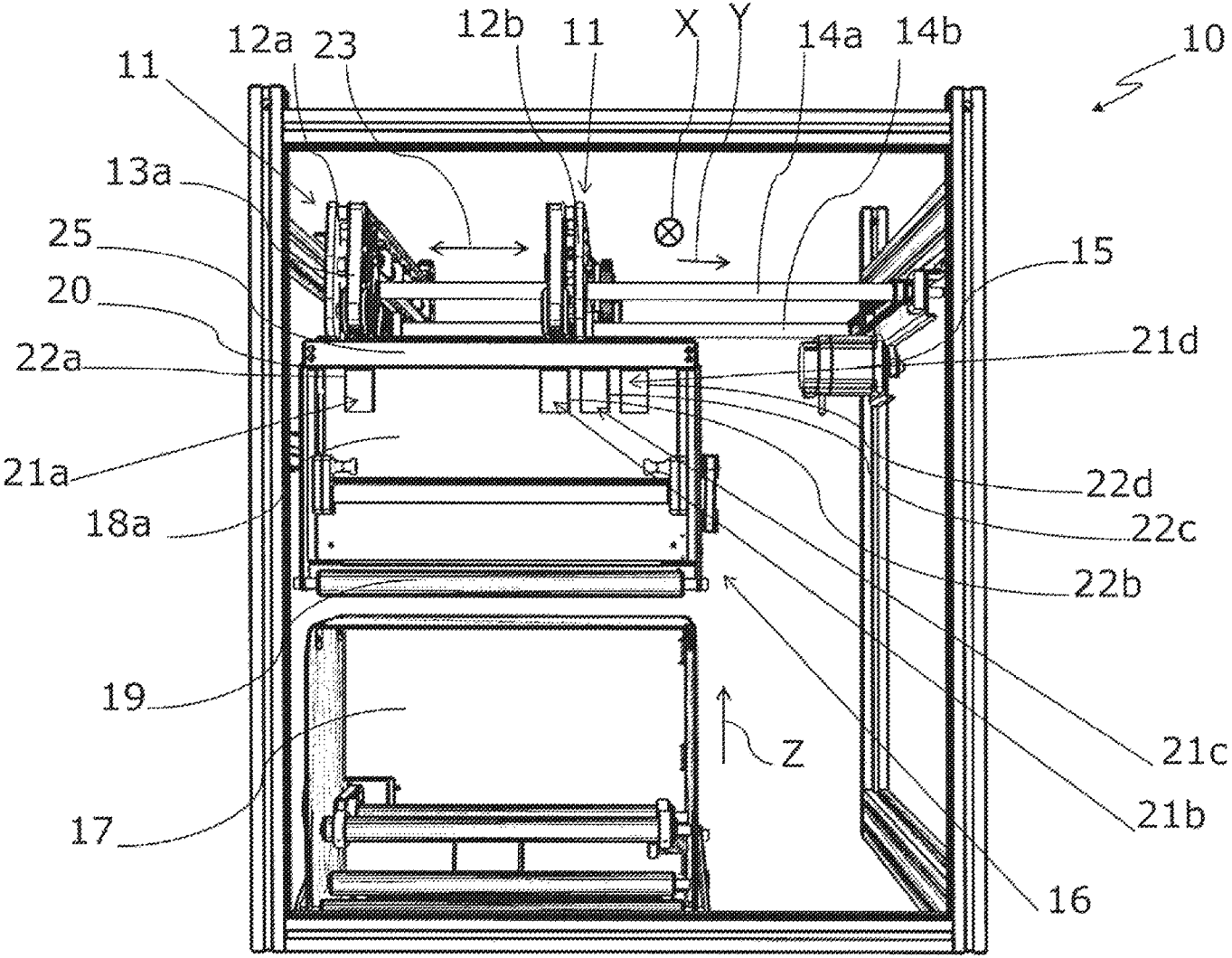
FIG. 1 an isometric front view of a packaging machine for packaging products to be packaged.

By contrast, in an embodiment, an object of the present invention is to modify a packaging machine of the type defined at the outset and a method of packaging in such a way that the packaging machine is more flexibly usable in its handling, and film consumption can be optimized for different sizes of the product to be packaged.

This object is achieved with regard to the device in a technically particularly simple and surprisingly effective manner by a generic packaging machine which is distinguished in that the guide plate of the film guiding element is vertically oriented, and the guide plate has at least one third recess along its edge toward the belt conveyors, the second belt conveyor being introducible into the third recess instead of the second recess in order to establish a second zero position with respect to the width of the film, and/or at least the second recess of the guide plate being formed in a displaceable recess element on the upper edge of the guide plate in order to establish the second zero position with respect to the width of the film.

As a rule, the belts are not guided into the recess; instead the plate is moved so that the belts are situated in the recesses when the plate is in the upper position.

The packaging machine according to the invention is relatively easily converted to film rolls of different width, and in fact even without a mechanical conversion on the packaging machine.

The spacing of the belt conveyors can be adapted to the respective width of the currently used film via the different zero positions without having to replace parts of the packaging machine for this purpose. This enables reliable transfer and reliable transport of films of different widths from the film guiding element into the belt conveyors of the film transport device.

In the first alternative of the invention which is particularly simple to produce, at least one third recess—in addition to the two known fixed recesses—is provided in the upper edge of the guide plate with which a further zero position can be set.

The same can be achieved in the second, somewhat more convenient alternative of the invention by means of a displaceable recess element on the upper edge in which the second recess is formed. This version of the invention also allows continuous instead of discrete adjustment of the first and all further zero positions.

As a result of the vertical alignment of the guide plate, the orientation of the film during the transfer from the film guiding element into the film transport device likewise takes place in the vertical direction. The film is thus transferred "standing," does not bend as easily as in a vertical or oblique direction, and can therefore more reliably be guided between two belts and ultimately securely transferred.

The vertical alignment of the guide plate also allows a substantial reduction in the footprint of the packaging machine as compared to other alignments of the guide plate that are known in the art.

This results in a slightly different arrangement of the deflecting rollers than was described, for example, in EP 3 093 244 B1, which was cited at the outset.

In advantageous embodiments, in particular in the first alternative of the packaging machine according to the invention, the guide plate has, in addition to the first recess, more than two further recesses, in particular three further recesses, into which the second belt conveying device can be introduced in order to establish more than two zero positions. This enables the reliable processing of a strip of film having different widths.

A preferred embodiment of the packaging machine is wherein the distances of the first recess from the other recesses correspond to commercially available widths of plastic packaging films. The packaging machine can then be adjusted precisely to the width of commercially available films.

A preferred embodiment, in particular the second alternative of the packaging machine according to the invention, is wherein the height of the recess element in the vertical direction is greater than or equal to the height of the first recess, the upper edge of the guide plate being aligned with the upper edge of the recess element, and the height of the second recess in the recess element being equal to the height of the first recess. In this way, the belt conveying devices can be inserted particularly easily into the recesses with the same configuration at the same depth.

In a further embodiment of the packaging machine, the displaceable recess element is latchable in a latching device. This allows stable positioning of the recess element at the different zero positions.

An advantageous further development of this embodiment is wherein the latching device has various latching points along the top edge of the guide plate, the distances of which from the first recess correspond in particular to the widths of commercially available plastic packaging films. This allows the recess element to easily and quickly be positioned at the correct distances from the first recess.

The packaging machine according to a further preferred embodiment can be wherein there is a further guide plate which runs horizontally spaced apart from and parallel to the first guide plate, and which has recesses of the same design as the first guide plate, the film being transportable in the intermediate space between the two guide plates. By transporting the film between two guide plates, a foldover of the film is prevented more effectively. In particular when the two guide plates are arranged vertically, the force of gravity acts on the film only in a direction parallel to the plane of the film, not in a direction perpendicular to the plane of the film. Bending of the film in the direction perpendicular to the plane of the film is prevented on each side by a guide plate in each case.

An advantageous embodiment is wherein the packaging machine has deflection rollers, each of which guides one of the transport belts in continuous circulation and is arranged at the end in the respective transport belt, guide rollers for guiding the transport belts being mounted in the transport belts downstream of the deflection rollers relative to the film transport direction.

In a preferred further development of this embodiment, the belt conveyors each have a first, second, third, fourth, fifth and sixth guide roller. In this case, the first guide roller guides the strand of the first transport belt facing away from the second transport belt while forming a bend. The second and the third guide roller guide the strand of the first transport belt that faces toward the second transport belt. The fourth and fifth guide rollers guide the strand of the second transport belt that faces toward the first transport belt while forming a bend in each case. The sixth guide roller guides the strand of the second transport belt facing away from the first transport belt while forming a bend. This arrangement of deflection rollers and guide rollers makes it possible to transfer the transport belts from a substantially vertical orientation to a horizontal orientation. For this purpose, the first and second transport belts can rest against one another in order to transfer the bending of one transport belt to the other.

Another preferred embodiment is wherein, after introduction of the film into the film transport device for guiding the film to a product to be packaged, the belt conveyors can be distanced from one another at a distance in the direction perpendicular to the film transport direction in order to stretch the film. This has the effect that the film rests smoothly against the product to be packaged without wrinkles or gaps.

The packaging machine according to another advantageous embodiment can be wherein a product to be packaged, in particular a tray, can be transported between the belt conveyors to the film by means of a device for transporting the product to be packaged. The product to be packaged may be brought by a conveyor belt and a lifting table between the belt conveyors and thus easily be brought against the film.

In a further class of preferred embodiments, the packaging machine according to the invention comprises a film transport device in which the two opposing transport belts of a belt conveyor have a first and a second deflection roller. The deflection rollers each guide one of the transport belts in continuous circulation and are arranged at the end in the respective transport belt. The packaging machine in this further design is wherein the first deflection roller has an end portion that projects past its associated transport belts. The first deflection roller has a first transport ring at the end portion along its circumference. The second deflection roller has an end portion that projects past its associated transport belt. The second deflection roller has a second transport ring on the end portion along its circumference.

A first contact surface of the first transport ring extends with mechanical friction along the circumference of the first deflection roller. A second contact surface of the second transport ring extends with mechanical friction along the circumference of the second deflection roller. The contact surfaces rest against one another with frictional engagement. The end sections of the deflection rollers can securely grip the film by the frictional engagement and thus ensure a stable transfer of the film from the film guiding element into the film transport device.

The scope of the present invention also includes a method for packaging products to be packaged in a packaging machine according to the invention by means of an expandable film. The latter is introduced by a movable film guiding element into a film transport device for feeding film to a product to be packaged. In this case, the film is transported by the film transport device in a film transport direction. After transport of the film by the film transport device, the film is wrapped around a product to be packaged. When the film is introduced into the film transport device, a first belt conveying device is introduced into a first recess of a guide plate of the film guiding element, and a second belt conveying device is introduced into a second recess of the guide plate in order to determine a first zero position with respect to the width of the film. At least the second belt conveyor is movable in a direction perpendicular to the film transport direction.

The method is wherein the second belt conveyor is introduced into a third recess of the guide plate instead of the second recess in order to determine a second zero position with respect to the width of the currently used film. Alternatively, in order to establish the second zero position, the recess element on the upper edge of the guide plate is displaced, and the second belt conveyor is introduced into the second recess on the recess element. In this method, the spacing of the belt conveyors is adapted to the width of the film via the various zero positions without having to replace parts of the packaging machine for this purpose. The film can be transferred reliably and quickly from the film guiding element into the belt conveyors of the film transport device for different widths of the film.

An advantageous embodiment of this method is wherein the film guiding element with the guide plate is moved between a film dispensing device and the film transport device for supplying film to a product to be packaged in order to supply a film to the film transport device. This allows for reliable transfer of the film to occur at different distances between the film dispensing device and film transport device.

A further embodiment of the method is wherein the film is cut to a desired length of film by means of a film cutting device arranged upstream of the film transport device relative to the film transport direction. For introducing the film into the film transport device, the guide plates of the film guiding element are guided by the film cutting device. After the introduction of the film into the film transport device, the guide plates of the film guiding element are moved out of the cutting device, so that the blades of the film cutting device can cut the film. The film is thus cut to the desired length before the cut film piece is transported through the film transport device into a packaging position.

FIG. 1 shows an isometric front view of a packaging machine 10 according to the invention for packaging products to be packaged by means of an expandable film.

The packaging machine has a film transport device 11 for supplying film to a product to be packaged. A first belt conveyor 12*a* and a second belt conveyor 12*b* for transporting the film form components of the film transport device 11. The first and second belt conveyors 12*a*, 12*b* each have first and second transport belts 13*a*, 13*b* (see FIG. 2). The transport belts 13*a*, 13*b* are driven synchronously in a film transport direction X predetermined by the film transport device 11 (in FIG. 1 into the paper plane, represented by a cross) and arranged adjacent to one another. The second belt conveyor 12*b* is movable in a direction Y perpendicular to the film transport direction X by spindles 14*a*, 14*b* and a spindle motor 15. With a film guiding element 16 of the packaging machine 10 movable in the vertical direction Z, the film can be introduced into the film transport device 11 from a film dispensing device 17. The term "vertical" relates in particular to the direction parallel to gravitational force. The film dispensing device 17 is formed below the film guiding element 16, and the film transport device 11 is formed above the film guiding element 16. The film guiding element 16 has a first guide plate 18*a* and a second guide plate 18*b* (see FIG. 2). The guide plates 18*a* 18*b* are vertically aligned. The film can be inserted between the guide plates 18*a*, 18*b* via a deflecting roller 19 of the film guiding element 16 at the lower end of the film guiding element 16.

A first recess 21*a* as well as a second, third and fourth recess 21*b*, 21*c*, 21*d* are formed in an upper edge 20 of the guide plate 18*a* in the vertical direction Z toward the belt conveyors 12*a*, 12*b*. The film guiding element 16 is movable in the vertical direction Z. As a result, the guide plate 18*a* can be moved to the height of the belt conveyors. The border 22*a* of the first recess surrounds the first belt conveyor 12*a*. Depending on the position of the movable second belt conveyor 12*b*, the borders 22*b*, 22*c*, 22*d* of the second, third or fourth recesses 21*b*, 21*c*, 21*d* surround the second belt conveyor 12*b*. As a result, the belt conveyors 12*a*, 12*b* are introduced into the recesses 21*a*-21*d*. The selection between the second, third or fourth recess 21*b*-21*d* is such that the spacing 23 of the belt conveyors 12*a*, 12*b* in the recesses 21*a*-21*d* corresponds to the width of the film. This defines the zero positions of the belt conveyors with respect to the width of the film. When the second recess 21*b* surrounds the second belt conveyor 12*b*, this is referred to in the context of the application as "first zero position." When the third recess 21*c* surrounds the second belt conveyor 12*b*, this is referred to in the context of the application as "second zero position." Accordingly, one may refer to a "third zero position" if the fourth recess 21*d* surrounds the second belt conveyor 12*b*. Further recesses (not specifically illustrated in the drawing) can correspondingly determine further zero positions.

A film cutting device 25 is arranged in the vertical direction below the belt conveyors. The film is transported by the belt conveyors 12*a*, 12*b* until the film has a sufficient length, as measured from the film cutting device 25, for the desired packaging process. The film guiding element 16 with the guide plates 18*a* 18*b* is then moved downward in the vertical direction toward the film dispensing device 17. The guide plates 18*a*, 18*b* of the film guiding element 16 thus exit the film cutting device 25. The film cutting device 25 then cuts through the film. The cut-off film is then further transported by the belt conveyors 12*a*, 12*b* until the cut portion of the film is arranged in a position vertically above a lifting table. The lifting table will later move the product to be packaged in a vertical direction. Thus, the cut portion of film is arranged vertically above the product to be packaged between the belt conveyors 12*a*, 12*b*. The film is stretched by a movement of the belt conveyor 12*b* in the direction Y perpendicular to the film transport direction X. A product to be packaged, for example a tray, can be fed by a packaging product transport device to the film between the transport belts 13*a*, 13*b*. Such a packaging product transport device may include a supply conveyor belt and a lifting table, as described in the above-cited EP 3,093,244 B1. When the product to be packaged is fed to the film by a lifting process, the film wraps around the product to be packaged. The film can be wrapped around the product to be packaged by folding claws. The product to be packaged can then be pushed by a pusher onto a sealing plate on which the film is welded and lastly can be transported away by a conveyor belt, as outlined in EP 3,093,244 B1.

Figure 2:
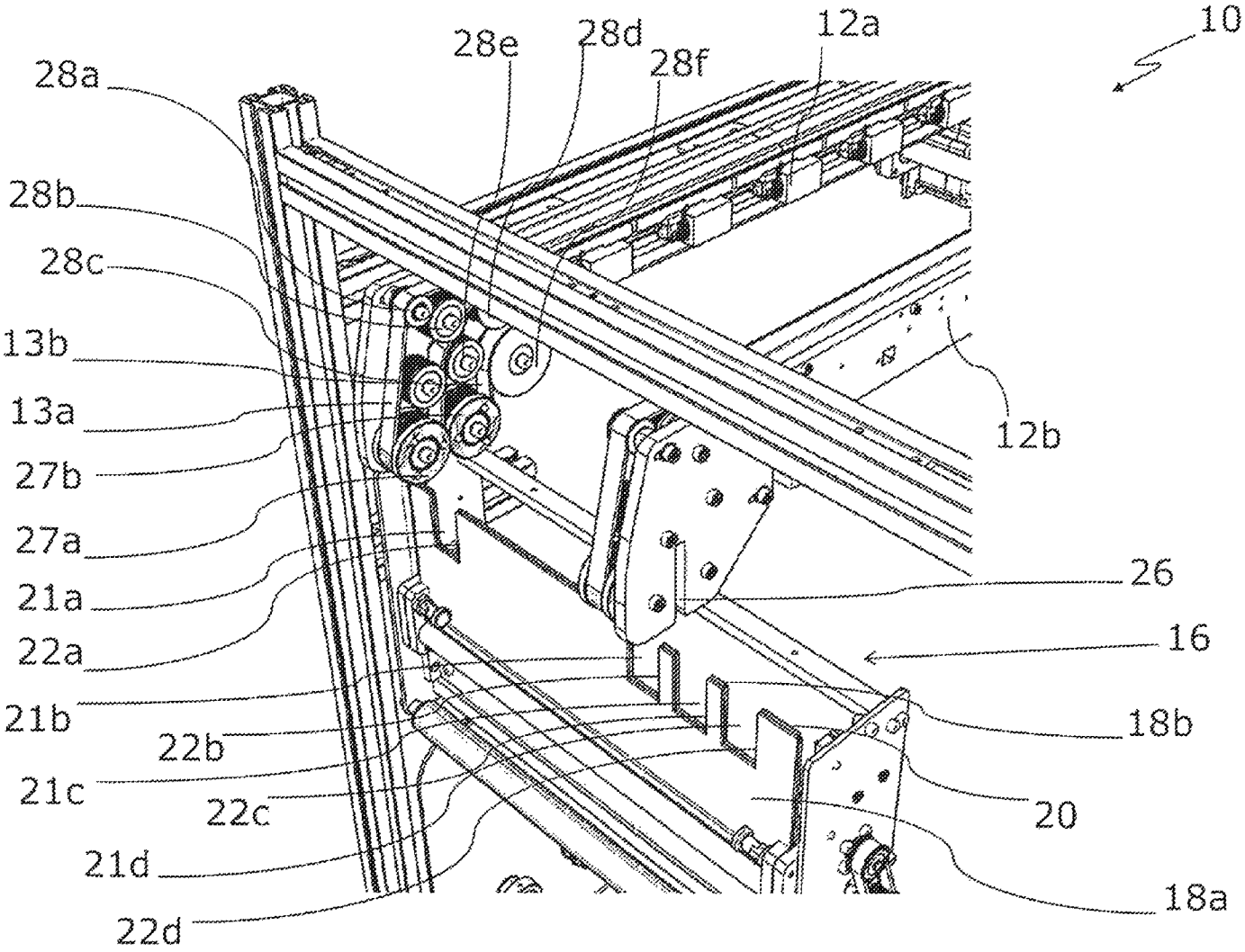
FIG. 2 an isometric front view of a section of the packaging machine with belt conveyors and a film guiding element obliquely from above.

FIG. 2 shows an isometric front view of a section of the packaging machine 10 with the belt conveyors 12*a*, 12*b* and film guiding element 16 obliquely from above. For greater clarity, the film cutting device 25 is not shown in FIG. 2. In particular the first and second guide plates 18*a*, 18*b* of the film guiding element 16 are shown, between which the film is transported. The belt conveyors 12*a*, 12*b* have recesses 26 for the upper edge 20 of the guide plates 18*a*, 18*b*. In the state where the belt conveyors 12*a*, 12*b* are inserted into the recesses 21*a*-21*d*, the borders 22*a*-22*d* of the recesses 21*a*-21*d* surround the belt conveyors 12*a*, 12*b*. The transport belts 13*a*, 13*b* are guided in each case by a deflection roller 27*a*, 27*b* arranged at the end in the transport belts 13*a*, 13*b*. A first, second, third, fourth, fifth and sixth guide roller 28*a*, 28*b*, 28*c*, 28*d*, 28*e*, 28*f* for guiding the transport belts 13*a*, 13*b* are arranged downstream of the deflection rollers 27*a*, 27*b* relative to the film transport direction X.

Figure 3:
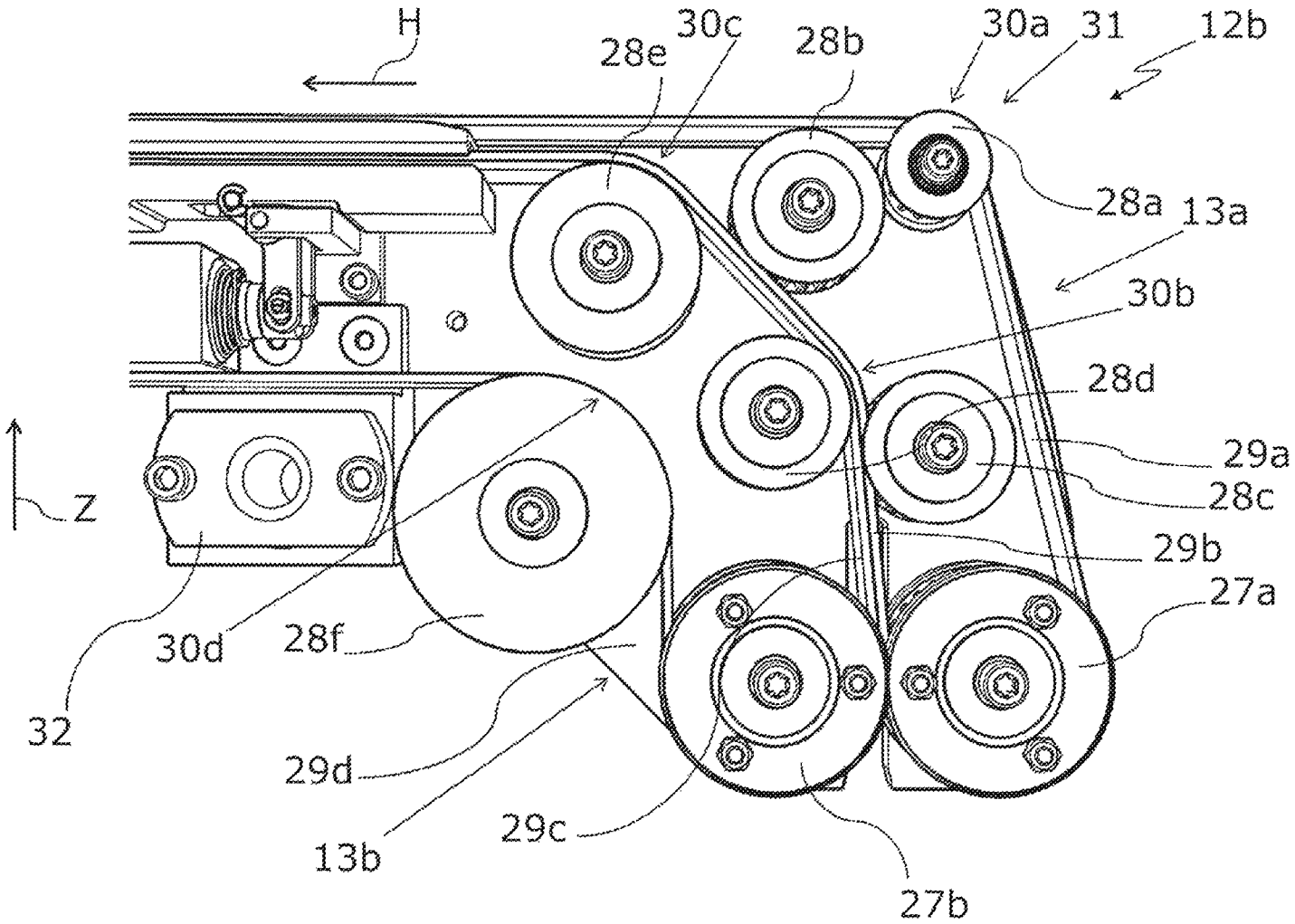
FIG. 3 a side view of one end of the belt conveyor with deflection rollers and guide rollers.

FIG. 3 shows a side view of one end 31 of the belt conveyor 12*b* with the deflection rollers 27*a*, 27*b* and the guide rollers 28*a*-28*f*. The first guide roller 28*a* guides the strand 29*a* of the first transport belt 13*a* which faces away from the second transport belt 13*b* while forming a bend 30*a* which transfers the strand 29*a* which faces away from the second transport belt 13*b* from a substantially vertical orientation Z to a horizontal orientation H. The second and third guide rollers 28*b*, 28*c* guide the strand 29*b* of the first transport belt 13*a* that faces toward the second transport belt 13*b*. The fourth and fifth guide rollers 28*d*, 28*e* guide the strand 29*c* of the second transport belt 13*b* that faces toward the first transport belt 13*a* while forming a bend 30*b*, 30*c*, these bends 30*b*, 30*c* effecting a transfer of the strand 29*c* that faces toward the first transport belt 13*a* from a substantially vertical orientation Z to a horizontal orientation H. The sixth guide roller 28*f* guides the strand 29*d* of the second transport belt 13*b* that faces away from the first transport belt 13*a* while forming a bend 30*d*, the bend 30*d* transferring the strand 29*d* that faces away from the first transport belt 13*a* from a substantially vertical orientation Z to a horizontal orientation H.

In particular, it is shown that the transport belts 13*a*, 13*b* rest against one another. As a result, the bends 30*b* 30*c* of the strand 29*c* of the second transport belt 13*b* that faces toward the first transport belt 13*a* are transferred to the strand 29*b* of the first transport belt 13*a* that faces toward the second transport belt 13*b*. For transport, the film can be introduced between the two transport belts 13*a*, 13*b* that rest against each other.

A spindle nut 32 of the belt conveyor 12*b* enables the belt conveyor 12*b* to be guided in the direction Y perpendicular to the film transport direction X (see FIG. 1) via a spindle 14*a*, 14*b* (see FIG. 1) for adjusting the distance of the belt conveyors 12*a*, 12*b*. The belt conveyor 12*a* remains fixed in the Y direction. The distance between the two belt conveyors 12*a*, 12*b* can thereby be changed.

Figure 4:
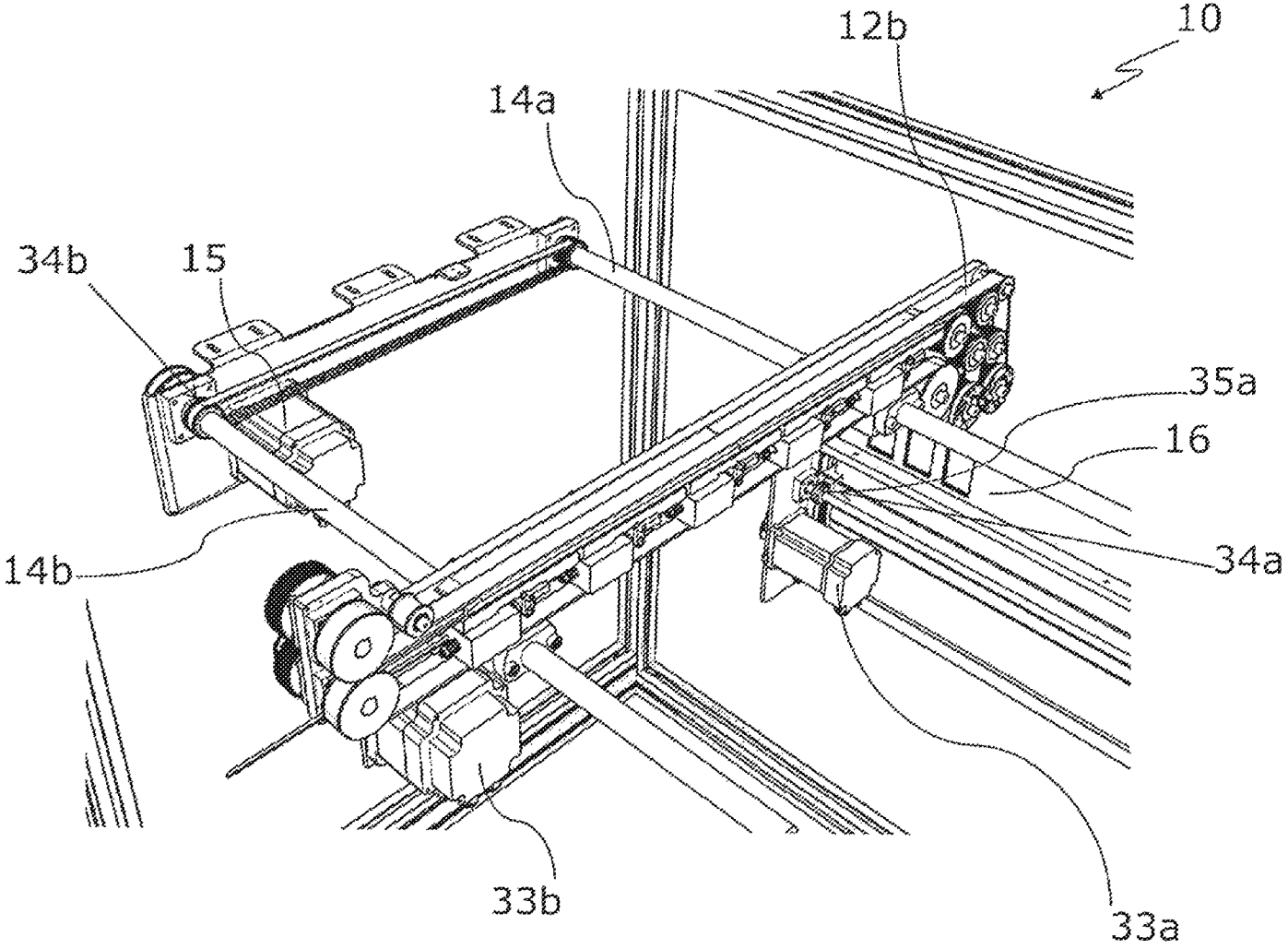
FIG. 4 an isometric view of a portion of the packaging machine with the belt conveyor and the film guiding element.

FIG. 4 shows an isometric view of a part of the packaging machine 10 with a belt conveyor 12*b* and the film guiding element 16. The film guiding element 16 has a first motor 33*a* and a first gear drive 34*a* with a gear 35*a* to move the film guiding element 16. The spindles 14*a*, 14*b* for lateral movement of the belt conveyor 12*b* are rotated by the spindle motor 15 with a second gear drive 34*b*. Also shown is a second motor 33*b* for driving the belt conveyor 12*b*.

Figure 5:
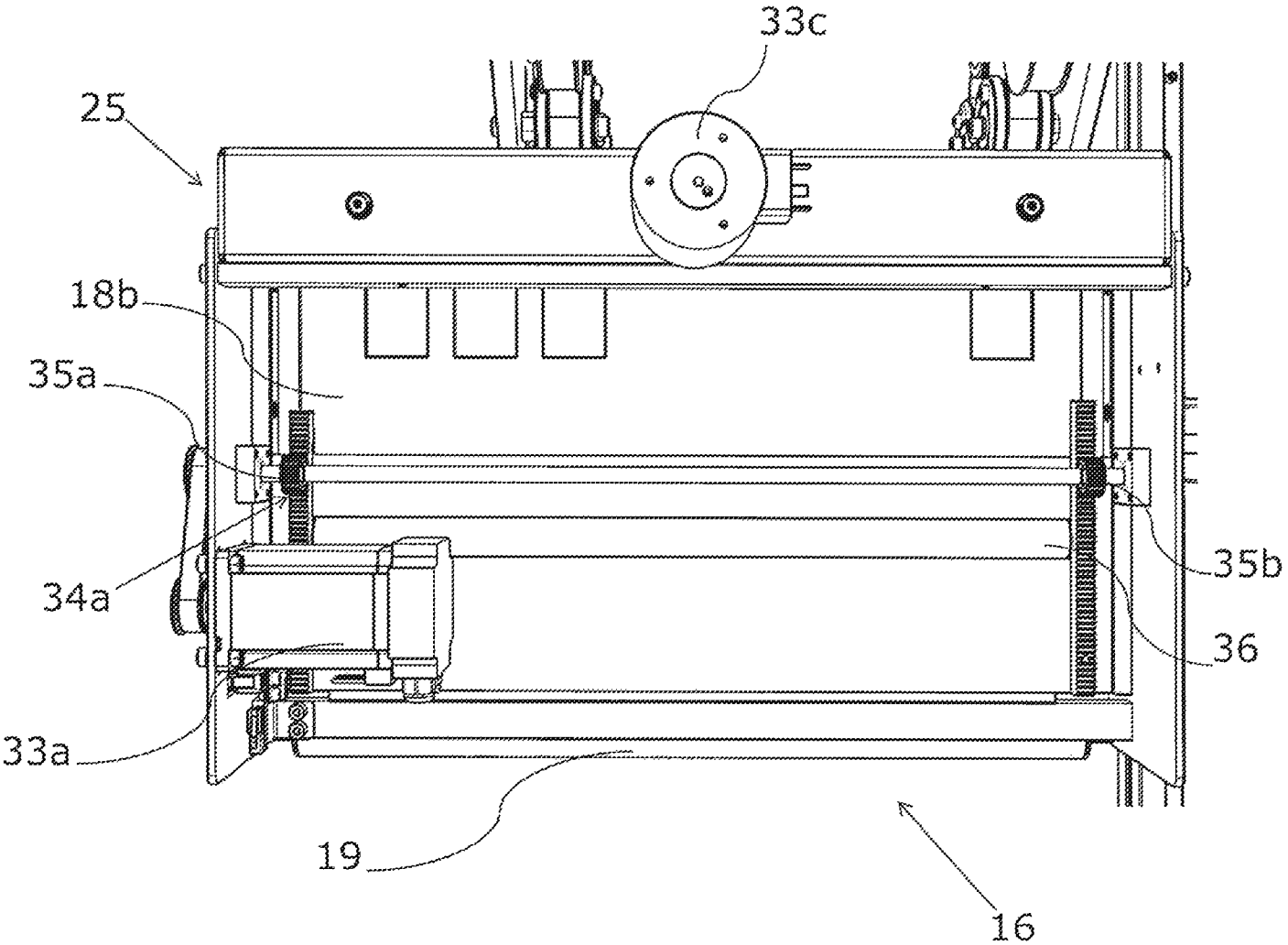
FIG. 5 an isometric rear view of the film guiding element and the film cutting device.

FIG. 5 illustrates an isometric rear view of the film guiding element 16 and the film cutting device 25. The movement of the film guiding element 16 is guided by the first gear drive 34*a* with gears 35*a*, 35*b* and the first motor. The film is guided out of the film dispensing device 17 (see FIG. 1) via a deflecting roller 19 of the film guiding element 16 and a rear guide roller 36 between the guide plates 18*a*, 18*b* (in FIG. 5: guide plate 18*b*). The film cutting device 25 has a lifting magnet 33*c* for driving the movement of the blade of the film cutting device 25 for cutting through the film.

Figure 6:
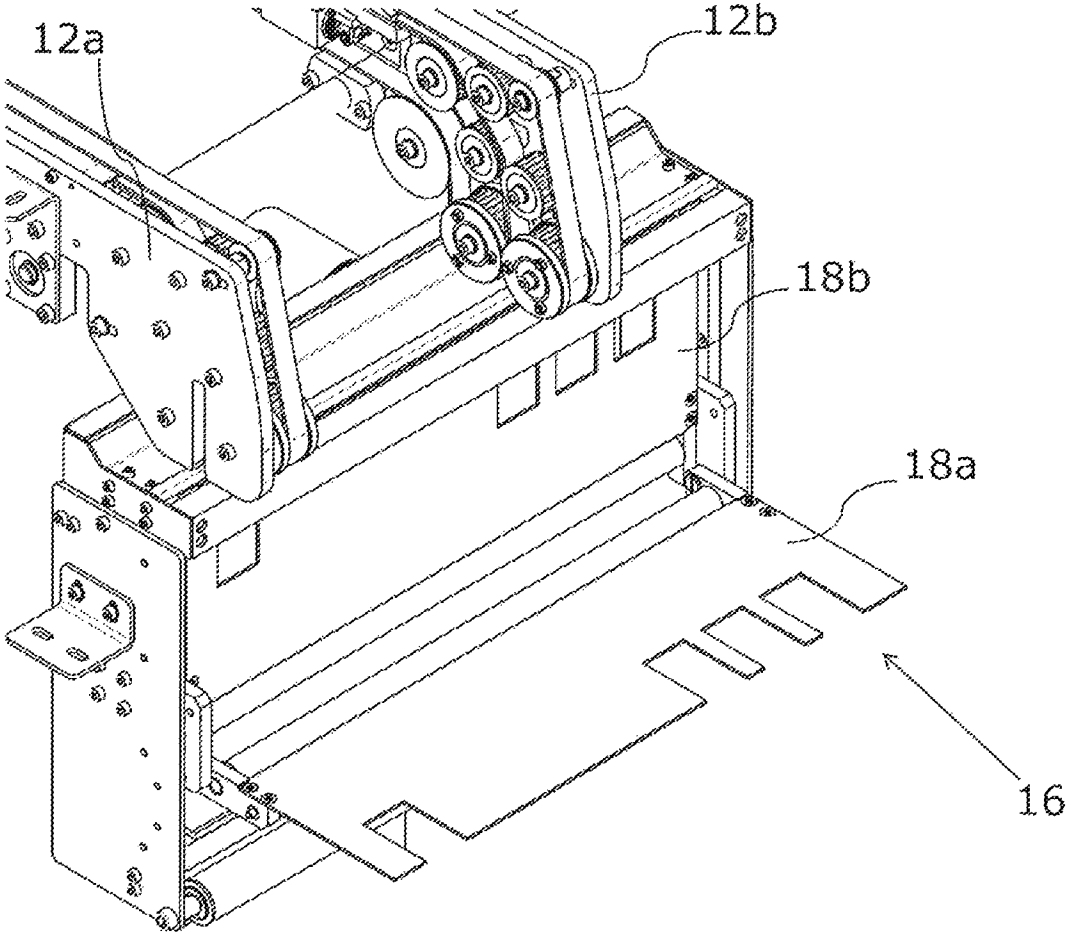
FIG. 6 an isometric view of the belt conveyors and the film guiding element in the open state.

FIG. 6 shows an isometric view of the belt conveyors 12*a*, 12*b* and the film guiding element 16 with the guide plates 18*a*, 18*b* in the open state. The first guide plate 18*a* is folded open. This allows a film in the film guiding element 16 to be inserted between the two film plates 18*a*, 18*b*. Once the film has been inserted, the guide plate 18*a* can be folded back, and the film guiding element 16 can thus be closed.

Figure 7:
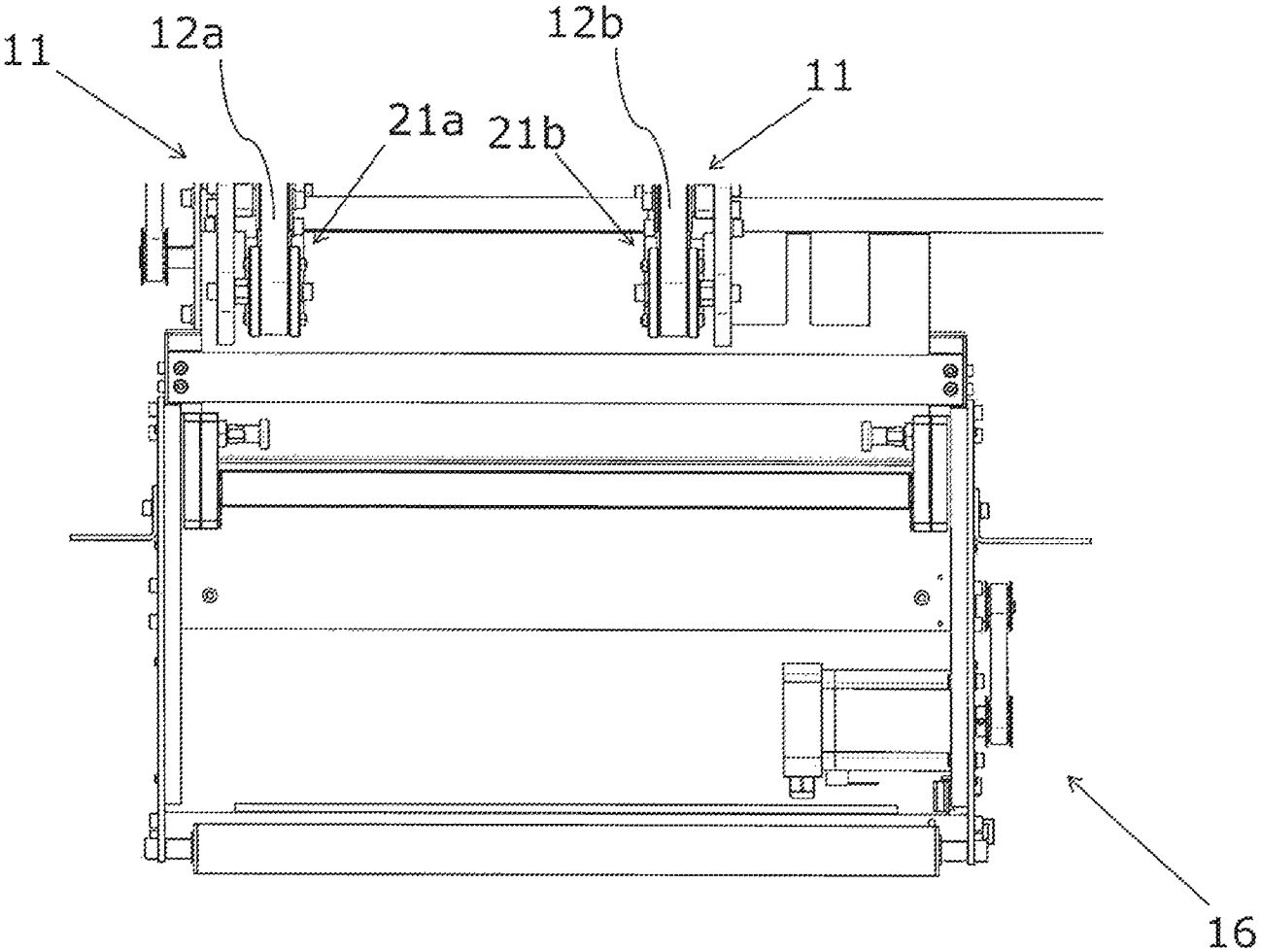
FIG. 7 an isometric front view of the film guiding element and the lower side of the belt conveyors, the film guiding element being moved to its uppermost position.

FIG. 7 shows an isometric front view of the film guiding element 16 and the lower side of the belt conveyors 12*a*, 12*b*, the film guiding element 16 being moved to its uppermost position; The belt conveyors 12*a*, 12*b* are in the first zero position. The first belt conveyor 12*a* is introduced into the first recess 21*a* and the second belt conveyor 12*b* into the second recess 21*b*. The film in the film guiding element 16 is inserted into the belt conveyors 12*a*, 12*b* and thereby transferred to the film transport device 11.

Figure 8:
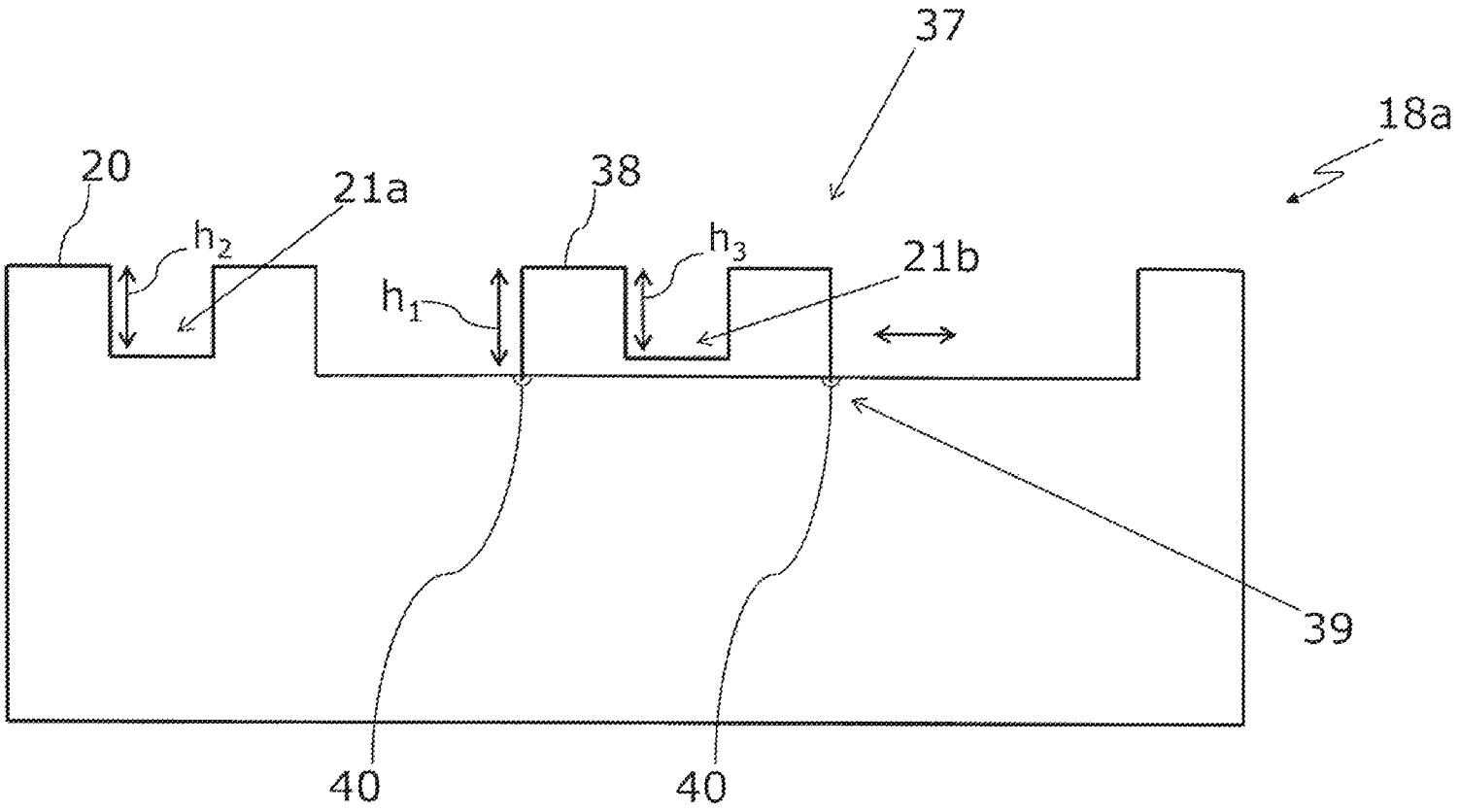
FIG. 8 a longitudinal section of the guide plate of the film guiding element (see FIG. 1) in a second embodiment.

FIG. 8 shows a longitudinal section of the guide plate 18*a* of the film guiding element 16 (see FIG. 1) in a second embodiment. The guide plate 18*a* has a displaceable recess element 37 in which the second recess 21*b* is formed. The height $h_1$ of the recess element 37 in the vertical direction Z is greater than the height $h_2$ of the first recess 21*a*. In this situation, the upper edge 20 of the guide plate 18*a* and the upper edge 38 of the recess element 37 are flush. The height $h_3$ of the second recess 21*b* is equal to the height $h_2$ of the first recess 21*b*. Then the first and second belt conveyors 12*a*, 12*b* (see FIG. 1) can be introduced into the first and second recess 21*a*, 21*b* by displacement of the guide plate 18*a* with the movable film guiding element 16 (see FIG. 1) after the second recess element 37 has been displaced to an appropriate location for establishing the zero position. For this purpose, the second recess element 37 can be latched in a latching device 39 having various latching points 40 along the upper edge of the guide plate, the distances of which from the first recess correspond to the commercially available widths of packaging films. The second guide plate 12*b* (not shown in FIG. 6) is designed accordingly.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMBERS

10 packaging machine
11 film transport device
12*a* first belt conveyor
12*b* second belt conveyor
13*b* first transport belt
13*b* second transport belt
14*a,b* spindles
15 spindle motor
16 film guiding element
17 film dispensing device
18*a* first guide plate
18*b* second guide plate
19 deflection roller
20 upper edge of the first guide plate
21*a* first recess
21*b* second recess
21*c,d* third and fourth recesses
22*a-d* borders
23 spacing of the belt conveyors in the recesses
25 film cutting device
26 recesses of the belt conveyors
27*a,b* deflection rollers
28*a-f* guide rollers
29*a-d* strands
30*a-d* bends
31 end of first belt conveyor
32 spindle nut
33*a* motor
33*c* solenoid
34*a,b* gear drive
35*a,b* gears
36 rear guide roller
37 displaceable recess element
38 upper edge of the recess element
39 latching mechanism
40 latching points
X horizontal transportation direction
Y horizontal direction perpendicular to X
Z vertical direction perpendicular to X and Y
$h_1$ height of recess element
$h_2$ height of the first recess
$h_3$ height of second recess

What is claimed is:

1. A packaging machine for packaging products to be packaged by means of a stretchable film, comprising:

a film transport device for a film feed to a product to be packaged;

a first and a second belt conveyor configured to transport the film, the belt conveyors each comprising a first and a second belt conveyor that are synchronously driven in a film transport direction prescribed by the film transport device and are arranged side by side, at least the second belt conveyor device being movable in a direction perpendicular to a film transport direction; and a movable film guiding element, by which the film is introducible into the film transport device, the film guiding element comprising a guide plate configured to guide the film that has a first recess and a second recess in an upper edge in a vertical direction toward the belt conveyors, the first belt conveyor being introducible into the first recess and the second belt conveyor into the second recess, thereby defining a first zero position with respect to a width of the film, wherein the guide plate of the film guiding element is vertically oriented, and wherein the guide plate has at least a third recess along its edge facing toward the belt conveyors, the second belt conveyor being introducible into the third recess instead of the second recess in order to establish a second zero position with respect to the width of the film, or wherein at least the second recess of the guide plate is formed in a recess element which is displaceable along the upper edge of the guide plate in order to establish the second zero position with respect to the width of the film.

2. The packaging machine according to claim 1, wherein the guide plate has, in addition to the first recess, more than two further recesses, the more than two further recesses comprising three further recesses, into which the second belt conveying device is introducible for establishing more than two zero positions.

3. The packaging machine according to claim 1, wherein distances of the first recess from the further recesses correspond to commercially available widths of plastic packaging films.

4. The packaging machine according to claim 1, wherein a height of the displaceable recess element in a vertical direction is greater than or equal to a height of the first recess, the upper edge of the guide plate being flush with the upper edge of the recess element, and a height of the second recess in the recess element being equal to the height of the first recess.

5. The packaging machine according to claim 1, wherein the displaceable recess element is latchable in a latching device.

6. The packaging machine according to claim 5, wherein the latching device has various latching points along a top edge of the guide plate, distances of which from the first recess correspond to commercially available plastic packaging films.

7. The packaging machine according to claim 1, further comprising a further guide plate which runs horizontally spaced apart from and parallel to the guide plate and which has recesses of a same design as the guide plate, the film being transportable in an intermediate space between the two guide plates.

8. The packaging machine according to claim 1, further comprising:

deflection rollers, each of which is configured to guide one transport belt in continuous circulation and is arranged in a respective transport belt at ends; and guide rollers configured to guide the transport belts in the film transport direction, the guide rollers being mounted downstream of the deflection rollers.

9. The packaging machine according to claim 1, wherein the belt conveyors each have a first, second, third, fourth, fifth, and sixth guide roller, the first guide roller being configured to guide a strand of a first transport belt that faces away from a second transport belt while a bend is formed, the second and the third guide rollers being configured to guide a strand of the first transport belt that faces toward the second transport belt, the fourth and fifth guide rollers being configured to guide a strand of the second transport belt that faces toward the first transport belt while a bend is formed in each case, and the sixth guide roller being configured to guide a strand of the second transport belt that is away from the first transport belt while a bend is formed.

10. The packaging machine according to claim 1, wherein, after introduction of the film into the film transport device, the belt conveyors are distanceable from one another at a distance in a direction perpendicular to the film transport direction in order to stretch the film.

11. The packaging machine according to claim 1, wherein a product to be packaged comprising a tray, is transportable between belt conveyors to the film by a device configured to transport the product to be packaged.

12. The packaging machine according to claim 1, further comprising a film transport device in which the two opposite transport belts of a belt conveyor have a first and a second deflection roller, each of which is configured to guide one of the transport belts in continuous circulation and in which respective transport belts are arranged at an end, wherein the first deflection roller has an end portion that projects past its associated transport belts, the first deflection roller having a first transport ring at the end portion along its circumference, wherein the second deflection roller has an end portion that projects past the associated transport belts, the second deflection roller having a second transport ring at the end portion along its circumference, and wherein a first contact surface of the first transport ring extending with mechanical friction along the circumference of the first deflection roller, a second contact surface of the second transport ring extending with mechanical friction along the circumference of the second deflection roller, and the contact surfaces abut each other with frictional engagement.

13. A method of packaging products to be packaged in the packaging machine according to claim 1 by a stretchable film, the method comprising:

introducing the film by the movable film guiding element into the film transport device configured to guide film to the product to be packaged, the film being transported by the film transport device in a film transport direction;

wrapping the film around the product to be packaged after the film is transported by the film transport device;

introducing the first belt conveyor into the first recess of the guide plate of the film guiding element when introducing the film into the film transport device; and introducing the second belt conveyor into the second recess of the guide plate in order to establish the first zero position with respect to a width of the film, at least the second belt conveyor being movable in a direction perpendicular to the film transport direction, wherein the second belt conveyor is introduced into the third recess of the guide plate instead of the second recess in order to establish the second zero position with respect to the width of the currently used film, or the recess element on the upper edge of the guide plate is displaced and the second belt conveyor is introduced into the second recess on the recess element in order to determine the second zero position.

14. The method according to claim 13, further comprising moving the film guiding element with the guide plate between a film dispensing device and the film transport device in order to supply the film to the film transport device.

15. The method according to claim 13, further comprising cutting the film to a desired length of film by a film cutting device arranged upstream of the film transport device relative to the film transport direction.

* * * * *